United States Patent [19]

Fleischmann et al.

[11] 4,124,453

[45] Nov. 7, 1978

[54] ELECTROCHEMICAL PROCESSES

[75] Inventors: Martin Fleischmann, Eastleigh; Francis Goodridge; Christopher J. H. King, both of Newcastle-upon-Tyne, all of England

[73] Assignee: National Research Development Corporation, London, England

[21] Appl. No.: 617,489

[22] Filed: Sep. 29, 1975

[51] Int. Cl.[2] ..... B01K 1/00

[52] U.S. Cl. ..... 204/1 R; 204/59 R; 204/72; 204/95; 204/256; 204/268

[58] Field of Search ..... 204/1 R, 59 R, 222, 204/223, 254–256, 268, 72, 95

[56] References Cited

U.S. PATENT DOCUMENTS

| | | | |
|---|---|---|---|
| 3,652,430 | 3/1972 | Beck et al. | 204/59 R |
| 3,716,459 | 2/1973 | Salter et al. | 204/1 R |
| 3,721,611 | 3/1973 | Jones | 204/1 R |
| 3,756,928 | 9/1973 | Eisele et al. | 204/59 R |
| 3,761,383 | 9/1973 | Backhurst et al. | 204/268 |
| 3,896,011 | 7/1975 | Isoya et al. | 204/59 R |
| 3,919,062 | 11/1975 | Lundquist et al. | 204/254 |
| 3,941,669 | 3/1976 | Bharucha et al. | 204/222 |
| 3,945,892 | 3/1976 | James et al. | 204/1 R |

*Primary Examiner*—T. Tung

*Attorney, Agent, or Firm*—Carroll F. Palmer

[57] ABSTRACT

A method of carrying out an electrochemical reaction comprises setting up a fluidized bed of particles at least some of which have at least their surfaces conducting or semi-conducting, using upwardly flowing liquid electrolyte, with or without reactant liquid, for the purpose, and applying a voltage gradient across at least a portion of said fluidized bed of particles, the size of particles, the conductivity of and rate of flow of the said electrolyte and/or reactant liquid and the voltage gradient being such that not only are anodic and cathodic faces established in respect of each of some of the at least partly conducting particles but the electropotentials on said faces on substantially each bipolar particle are such that said electrochemical reaction takes place on at least some of said bipolar particles but only on one portion of the surfaces thereon of said particles. The said bipolar particles which, preferably, are spherical or cylindrical may comprise solid conducting or semi-conducting material or cores of non-conducting material with coatings of conducting or non-conducting material thereon.

The said method may be, for example, the electrolysis of sea water for the production of hypochlorite or of bromide solution for the production of hypobromite or the decarboxylation of monomethyl adipate to dimethyl sebacate.

13 Claims, 3 Drawing Figures

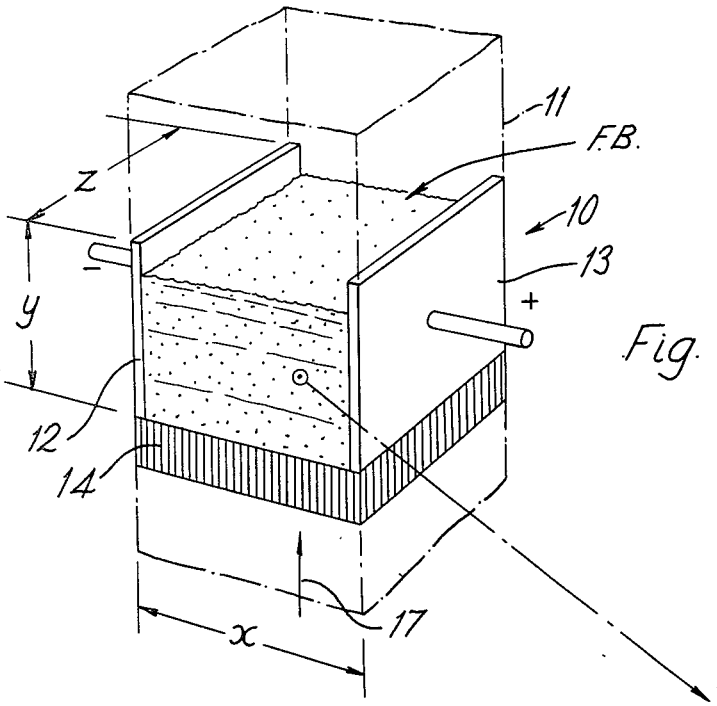
Fig. 1
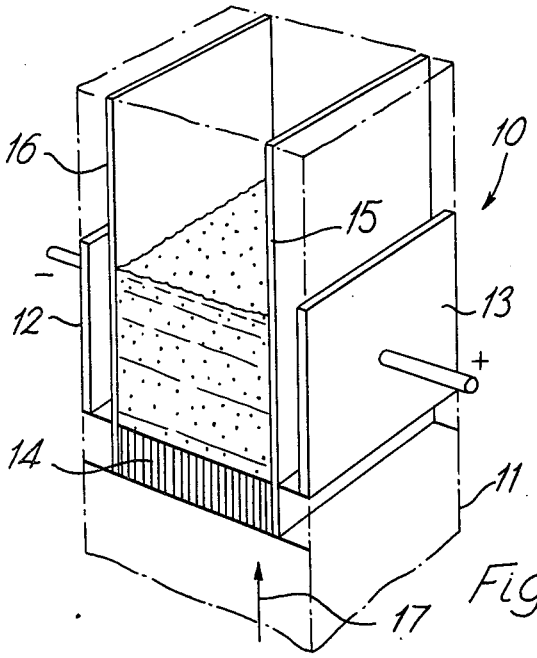
Fig. 2
Fig. 3
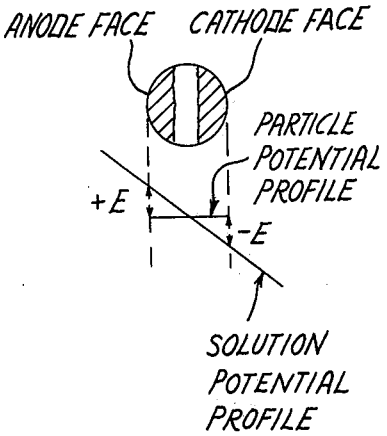

ELECTROCHEMICAL PROCESSES

This invention relates to electrochemical cells and more particularly concerns cells which, in operation, incorporate fluidised beds of conducting or semi-conducting particles. In this sense, a fluidised bed of particles means a bed of particles which at least in operation of the cell is maintained in an expanded state by upward flow therethrough of a liquid which will normally be electrolyte but which may contain an admixture of reactant liquid(s) and/or gas(es), the particles normally remaining in the cell with a stream of liquid(s) with or without entrained gas(es) above the expanded bed.

In accordance with the invention, a method of carrying out electrochemical reactions comprises setting up a bed of particles in an electrochemical cell, the surfaces at least of at least some of said particles being electronically conductive or semi-conductive, passing electrolyte liquid and/or liquid reactant(s), with or without gas(es) entrained therewith, upwards through said bed to form a fluidised bed of particles, and applying a voltage gradient across at least a portion of said fluidised bed, the size of particles, the conductivity and rate of flow of said liquid(s), and the voltage gradient being such that not only are anodic and cathodic faces established on each of at least some particles of the said fluidised bed but the electropotential on said faces on substantially each bipolar particle is such that said electrochemical reactions take place on at least some of said bipolar particles but only on portions of the surfaces thereof.

The particles of the bed may be solid conducting, or semi-conducting, material or may comprise cores of non-conducting material with a coating or coatings of one or more conducting, or semi-conducting, material(s) thereon. The bed may comprise mixtures of such particles. For certain reactions, carbon, possibly in the form of graphite is found to be suitable as the material of the particles but any suitable material may be used for the particles or for the core or coating of particles of the cored type. This will be clear to those skilled in the art. Spheres or cylinders or a mixture of spheres and cylinders may be used and the use of cylinders is advantageous from the point of relative cost for the same equivalent surface area. The cylinders will preferably have a length to diameter ratio of unity. Other shapes, or mixtures of shapes, however may be used as desired or as found convenient.

In order that the invention may be more fully understood, certain reactions using the method of the invention will be described by way of example with reference to the accompanying drawings, of which FIG. 1 illustrates diagrammatically one form of fluidised bed cell and FIG. 2 an alternative form. FIG. 3 shows a depiction of an individual particle of a bed as illustrated by either FIG. 1 or FIG. 2 of the potential profile across the particle in relation to the local profile of potential in the electrolyte solution.

In FIG. 1, and similarly in FIG. 2, the cell 10 comprises a compartment 11 of rectangular, or square, horizontal section. At two opposite sides thereof a cathode 12 and an anode 13 are set up above a porous distributor base 14 for distributing electrolyte liquid which flows upwards as indicated by the arrow 17 through the base to the electrode space and out through a part of the cell above the electrodes. A bed of particles arranged on the distributor base 14 can be caused to become expanded and to form a fluidised bed FB if the rate of flow of the liquid is adjusted in known manner to the desired value. There is no necessity for the lower part of the electrodes to be situated at the level of the top of the distributor base 14 though this will be obviously advantageous from the point of being able then to arrange for the electrode surface to extend over the full height of the fluidised bed, if desired. It is not essential, however, that the electrodes should extend over the whole height of the expanded bed.

With the fluidised bed set up as shown in FIG. 1, or FIG. 2, and with a small potential difference applied to the electrodes 12 and 13 to produce a low voltage gradient across the electrolyte path between the two electrodes, each particle of the bed will assume, at any particular moment in time, the potential associated with its momentary position in the bed. If now the potential difference between the electrodes is increased, the voltage gradient increases and the associated potential of a particle also increases and there will come a time when the potential difference over portions of the electrolyte having a dimension commensurate with the sizes of individual particles, is appreciable. Since the particles are conducting, all parts of a particle will be at a common potential but now there will be a significant difference of potential in the electrolyte at opposite faces of the particle and each particle, therefore, becomes a bipolar cell. This effect is illustrated in FIG. 3. The electropotential difference, 2E, across each particle which is required before the particle can act as a bipolar cell will of course depend on the particular reaction which is proceeding. Looking again at FIG. 3, the conductivity of the electrolyte is chosen such that each particle in the bed experiences a sufficient potential gradient to establish anode and cathode faces. The voltage gradient required will, of course, also depend on the size of each particle.

One advantage over the monopolar fluidised bed electrode is that there is no limitation to scale up in the direction of current flow. On the other hand, the bipolar fluidised bed cell appears to be suitable only for electrochemical reactions that do not require a diaphragm to separate anolyte from catholyte or better still for reactions where intimate mixing of anolyte and catholyte is a distinct advantage.

Since the particles will be continuously in motion during the reaction and will, therefore, be rotating, portions which are anodic at one moment will become cathodic at the next and vice versa. It is hoped that this will clean the surface and avoid the passivation of particles experienced in some cases with the bipolar packed bed type of bipolar cell. If passivation of the planar anode 13 and cathode 12 is a problem then the arrangement illustrated in FIG. 2 could be used. Here the electrodes are separated from the bipolar fluidised particles by permeable, or semi-permeable, diaphragms or membranes 15 and 16 respectively, and an electrolyte or different electrolytes are passed between electrode 13 and diaphragm 15 and between electrode 12 and diaphragm 16, which do(es) not contain the passivating reactant or product.

Alternatively passivation may possibly be prevented in the cell of FIG. 1 by the expedient of arranging for periodic switching of the polarity of the electrodes 12 and 13.

In order to determine the advantages of using a bipolar fluidised bed cell of FIG. 1, tests can be carried out as follows:-

With a cell of dimensions $x = 7$ cm, $y = 15$ cm and $z = 7$ cm. and using graphite electrodes 12 and 13, hypobromite can be formed by the electrolysis of sodium bromide on the particles.

| | |
|---|---|
| Thus on the anode face: | $2Br^- \rightarrow Br_2 + 2e$ |
| cathode face: | $2H_2O + 2e \rightarrow 2OH^- + H_2$ |
| with the mixing of products: | $2OH^- + Br_2 \rightleftarrows OBr^- + Br^- + H_2O$ |

Using a total of approximately 5 liters of electrolyte, this is recycled through the cell at a flow rate of approximately 2 liters per second or as required to fluidise the bed to the extent of an expansion to 100% of the static bed height. The analysis of $BrO^-$ is carried out after each 1 minute of electrolysis and the electrolyte is replaced after each 1 minute of electrolysis and the results obtained are shown in the following Table.

| Run No. | Type and size of particle | Electrolyte Concentration in Mols. NaBr | Voltage across cell (volts) | Current (amp) | Apparent current efficiency (for formation of $BrO^-$) % | Conversion % |
|---|---|---|---|---|---|---|
| 1 | 2 mm Glass beads | 0.01 | 215 | 2.80 | 80 | 1.3 |
| 2 | 1–1.5 mm Graphite beads | 0.01 | 220 | 4.33 | 650 | 17 |
| 3 | 5 mm Solid graphite cylinders, (diam = height) | 0.01 | 215 | 10.50 | 480 | 29 |
| 4 | (as Run 3) | 0.1 | 49 | 10.00 | 250 | 3 |

Run No. 1 in the above Table shows the performance of the cell with only graphite planar electrodes active; this indicates that a current efficiency of about 80 percent can be expected for the particular reaction in the absence of electronically conducting particles. In contrast, Runs 2, 3 and 4 show that a marked increase of current efficiency is achieved by the introduction of such particles into the cell. These higher current efficiencies are evidence of the fact that the particles in the bed behave as bipolar cells. On the basis of Run 1, it can be said that Run 2 has an approximate equivalence to using 8 planar electrode cells having electrodes of the same size as in Run 1; Run 3 is approximately the equivalent of that resulting from use of 6 such planar electrode cells and Run 4 to approximately the equivalent of using 3 such cells. It is emphasised, however, that these results do not necessarily represent the use of optimum conditions for the production of $BrO^-$, but are shown merely for comparative purposes.

In use of the invention, the material of the particles is selected to be resistant to the reactants and to the products of the required reaction. Other variables are particle size, particle density, bed expansion, electrolyte concentration and electrolyte velocity, although certain of these will be interdependent.

To illustrate the effect of voltage gradient on operation of a fluidised bed cell, the same arrangement as for Run 4 may be used and for the same reaction. A voltage gradient below about 3.6 volts per cm is found to be too low for the particles to become active; however at higher voltage gradients, certainly at 6 volts per cm and higher, the bed of particles acts continuously as a number of bipoles. The following Table shows results obtained at increasing gradients.

| Cell voltage gradient volts per cm | Current Efficiency (based on planar electrodes) | Power consumption kWh per g.Mol of $Br_2$ | Space time yield g.Moles $s^{-1}$ $m^{-3}$ of bed | Current amps |
|---|---|---|---|---|
| 6.0 | 190% | 1.27 | 0.10 | 7.5 |
| 7.4 | 330% | 0.88 | 0.25 | 11.2 |
| 8.9 | 325% | 1.05 | 0.36 | 17.0 |
| 10.3 | 260% | 1.35 | 0.40 | 22.0 |

It will be apparent that although the cell described with reference to FIG. 1 or 2 incorporates a porous electrolyte distributor to achieve the flow of electrolyte required to produce the fluidised bed of particles, other ways of forming a fluidised bed are possible. Thus by suitably shaping the lower end of the cell, as by making it wedge shape, the flow of electrolyte entering the cell at the narrow bottom of the wedge will be induced to flow suitably upwards. A wedge shape half cell is described in British Pat. No. 1,203,001.

It is not necessary that the electrode arrangement should be vertical. By arranging a cathode member preferably horizontally below or even just above the porous distributor for the fluidised bed, or by making the distributor of conductive material to function as an electrode, the anode can be arranged substantially horizontally in the liquid above the normal top surface of the fluidised bed and the apparatus can still be made to function in accordance with the invention. There may be no necessity at all to interpose a diaphragm between the anode and the particles in this arrangement.

One particular illustration of use of the bipolar fuidised bed cell concerns electrolysis of sea water. Using samples from the east coast of England, the following results were obtained upon treatment in a cell containing graphite particles of 0.5 cm diameter with a bed expansion of approximately 50%:

For a power consumption of 1.3 kWh per g. mole of chlorine, the space time yield was $6.5 \times 10^{-1}$ g. moles per second per $m^3$ of bed and the concentration of hypochlorite at outlet from the cell was about 0.1 g. per liter of effluent.

Another illustration of the use of the bipolar fluidised bed cell is the electrolysis of monomethyl adipate for the production of dimethyl sebacate.

The cell used for this purpose may take the form of a glass tube of 2.8 cm diameter set vertically in a simple circulatory flow with water cooling at input to the circulating pump. The flow distributor on which the bed of particles rests when static is a platinum gauze of suitable mesh size, the particles being baked carbon 'spheres' of 1.7 to 2.0 mm. diameter; the static height of the bed is approximately 8.5 cm. The platinum gauze having a lead attached thereto is a current feeder, made the anode, and the cathode feeder is similarly a plantinum gauze wich is arranged to be movable above the bed, suspended from the top of the tube.

When the cell is assembled, the bed is caused to expand to about 10 cm. in height by adjustment of the flow of an electrolyte consisting of 75 g. monomethyl adipate and 0.6 g. sodium dissolved in methanol and the solution is made up to 0.6 liter with methanol, giving an expansion of approximately 17 to 18 percent.

On achieving the desired height of bed, the upper feeder electrode is lowered almost to touch the top surface of the bed and the current is switched on and the voltage is applied and brought up to a suitable value.

The reactions are as follows:

At the anode: $2CH_3O_2C\ (CH_2)_4CO_2^- \rightarrow CH_3O_2C\ (CH_2)_8CO_2CH_3 + 2\ CO_2 + 2e$ At the cathode: $2H^+ + 2e \rightarrow H_2$ One ml. samples of electrolyte are drawn off the system every 15 minutes and these are analysed to give results as follows:-

| Time mins. | Temp °C | Volts across cell | Current amp | Current Efficiency | Amount of product mM. | Power consumption kWh. $kgM^{-1} \times 10^{-3}$ | Space Time yield $kgM.s^{-1}m^{-3} \times 10^4$ of bed. |
|---|---|---|---|---|---|---|---|
| 0 | 19.5 | 500 | 1.1 | — | — | — | — |
| 15 | 34 | 500 | 0.9 | 878 | 38.7 | 3.16 | 3.9 |
| 30 | 33.5 | 500 | 0.88 | 890 | 74.8 | 3.12 | 3.8 |
| 45 | 32 | 500 | 0.8 | 885 | 108 | 3.14 | 3.75 |
| 60 | 30 | 500 | 0.65 | 770 | 120 | 3.60 | 3.0 |

The current efficiency figures when compared with the current efficiency of the electrolytic process on planar carbon electrodes which is only about 40%, show that the fluidised bed cell is equivalent to about 20 of the planar carbon electrode cells in this reaction.

We claim:

1. A method of carrying out an electrochemical reaction comprising setting up a bed of particles in an electrochemical cell, the surfaces at least of at least some of said particles being at least semi-conductive, passing liquid consisting of at least one of the grup consisting of electrolyte liquid, liquid reactant, electrolyte liquid with gases entrained therewith, and liquid reactants with gases entrained therewith, upwards through said bed of particles to form a fluidised bed of particles and applying a voltage gradient across at least a portion of said fluidised bed of particles, the size of particles, the conductivity of and rate of flow of said at least one liquid and the voltage gradient being such that not only are anodic and cathodic faces established in respect of each of at least some of said particles of the fluidised bed but the electropotentials on said faces on substantially each bipolar particle are such that said electrochemical reaction takes place on at least some of said bipolar particles but only on one portion of the surface thereon of said particles.

2. A method as claimed in claim 1, wherein at least some of said particles comprise cores of non-conducting material with a coating thereon of at least one material which is at least semi-conducting.

3. A method as claimed in claim 1, wherein at least those particles which are at least semi-conducting comprise cores of non-conducting material with a coating of at least one material which is at least semi-conducting.

4. A method as claimed in claim 1, wherein at least some of said particles are of shapes in the group consisting of spheres, cylinders and mixtures of spheres and cylinders.

5. A method of carrying out electrochemical reactions as claimed in claim 1, wherein said particles are retained between the faces of opposing electrode surfaces, said voltage gradient being obtained by applying a suitable voltage between said two electrodes.

6. A method of carrying out electrochemical reactions as claimed in claim 1, wherein said particles are retained within a container and said voltage gradient is applied by providing two spaced substantially parallel electrode surfaces, part at least of the said fluidised bed being arranged to be formed between said spaced electrode surfaces and a suitable voltage being applied between said two electrode surfaces.

7. A method of carrying out electrochemical reactions as claimed in claim 5, wherein said electrode surfaces are separated from said particles by membranes which are at least semi-permeable.

8. A method of carrying out electrochemical reactions as claimed in claim 1, wherein the expansion of the fluidised bed is limited to a maximum of between 10 and 20 percent.

9. A method of carrying out electrochemical reactions as claimed in claim 1, wherein the expansion of the fluidised bed is limited to a maximum of about 50 percent.

10. The method of claim 1 when used in the electrolysis of sea water for the production of hypochlorite.

11. The method of claim 1 when used in the electrolysis of bromide solution for the production of hypobromite.

12. The method of claim 1 when used for the decarboxylation of monomethyl adipate to dimethyl sebacate.

13. An electrochemical process comprising providing a bed of particles in an electrochemical cell, the surfaces of at least some of said particles being at least semi-conductive, passing liquid comprising reactant upwards through said bed of particles to expand the volume thereof and form a fluidised bed of particles and applying a voltage gradient across at least a portion of said fluidised bed of particles between substantially parallel plate electrodes, said voltage gradient being such that anodic and cathodic faces are established in respect of each of at least some of said particles of said fluidised bed with a potential drop on each such bipolar particle sufficient that electrochemical reaction takes place on at least some of such bipolar particles limited to a portion only of the surface of said particles.

* * * * *